US005292564A

United States Patent [19]

Lee

[11] Patent Number: 5,292,564

[45] Date of Patent: Mar. 8, 1994

[54] FLUID-CONTAINED DISPLAY ORNAMENT

[76] Inventor: Vincent K. W. Lee, No. 44, Lane 458, Sheh Chung Street, Taipei, Taiwan

[21] Appl. No.: 849,581

[22] Filed: Mar. 11, 1992

[51] Int. Cl.[5] ..... G09F 19/02

[52] U.S. Cl. ..... 428/13; 40/406; 446/267

[58] Field of Search ..... 441/7, 28, 32; 446/267; 116/228; 40/406, 409; 428/13

[56] References Cited

U.S. PATENT DOCUMENTS

| | | | |
|---|---|---|---|
| 479,530 | 7/1892 | Roberts | 446/267 X |
| 2,589,757 | 3/1952 | Williams | 428/13 X |
| 2,678,074 | 5/1954 | Adams | 116/228 X |
| 3,166,839 | 1/1965 | Dock et al. | 428/13 X |
| 4,643,693 | 2/1987 | Rubinstein | 428/13 X |

*Primary Examiner*—Henry F. Epstein
*Attorney, Agent, or Firm*—Bacon & Thomas

[57] ABSTRACT

A fluid-contained display ornament comprising a transparent fluid container for holding a fluid, a pilot device, and a display device having one end secured to one end of the transparent fluid container and an opposite end secured to the pilot device. The pilot device floats in the fluid to spread out the display for exhibition when the transparent fluid container stands up. The display device is forced by the pilot device to conceal itself at said one end of the transparent fluid container when the transparent fluid container is turned upside-down.

5 Claims, 6 Drawing Sheets

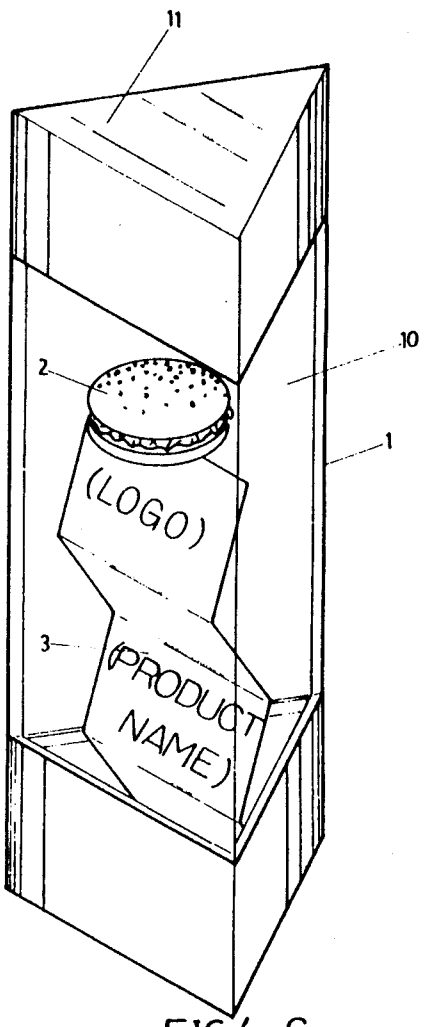
FIG 4-C
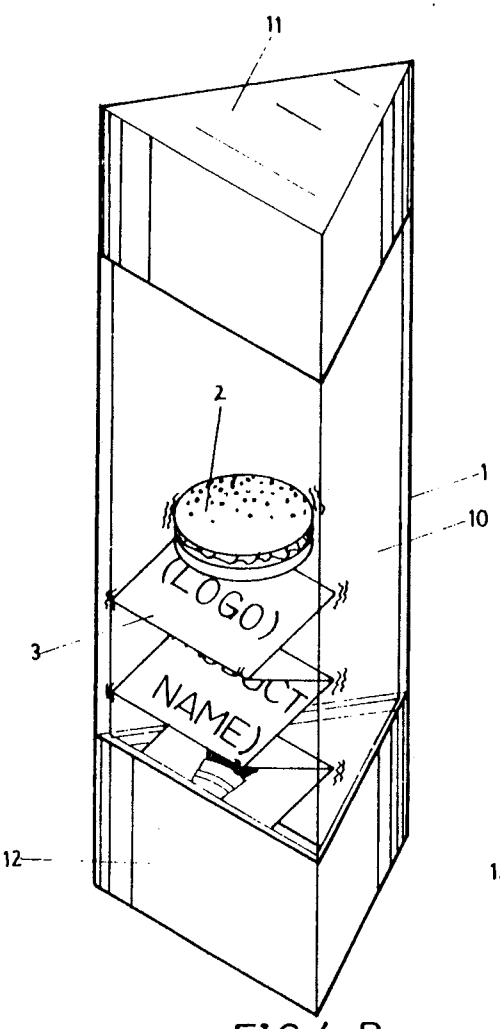
FIG 4-B
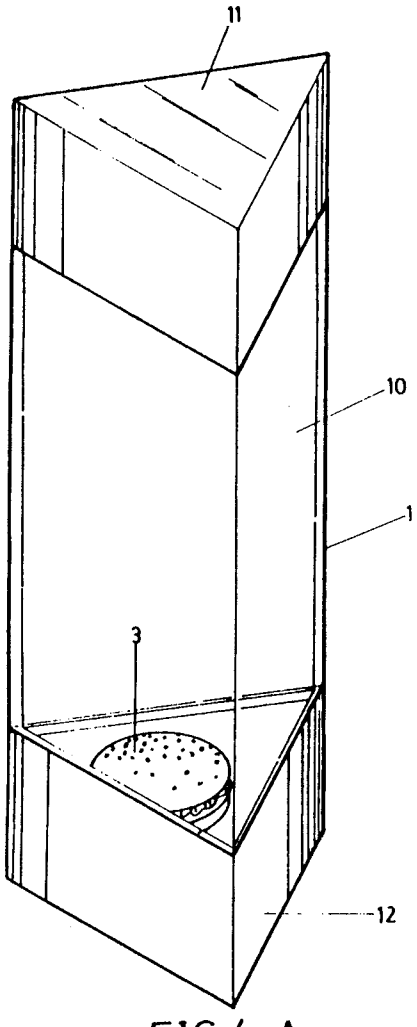
FIG 4-A

FLUID-CONTAINED DISPLAY ORNAMENT

BACKGROUND OF THE INVENTION

The present invention relates to fluid-contained display ornaments. More particularly, the present invention relates to a fluid-contained display ornament which extends out a display device for showing when it stands up or conceals such a display device from the sight when it is turned upside-down.

Several fluid-contained ornaments are known. These fluid-contained ornaments are generally comprised of a transparent fluid container having an ornamental float floating in a fluid contained therein. Moving the transparent fluid container of a fluid-contained ornament causes the ornamental float to navigate through waves.

SUMMARY OF THE INVENTION

The present invention provides a fluid-contained display ornament which serves to adorn and simultaneously spreads out displaying means for exhibition. According to the present invention, there is provided a fluid-contained display ornament which is generally comprised of a fluid container for holding a fluid, a pilot device, and a display device. The display device has one end secured to one end of the transparent fluid container and an opposite end secured to the pilot device. The pilot device floats in the fluid to spread out the display device for exhibition when the transparent fluid container stands up. The display device is forced by the pilot device to conceal at one one of the transparent fluid container when the transparent fluid container is turned upside-down. In an alternate form of the present invention, the pilot device sinks in the fluid to spread out a display device which hangs from a top end of the transparent fluid container. In this alternate form, the display device is forced by the pilot device to conceal itself from sight when the transparent fluid container is turned upside-down.

BRIEF DESCRIPTION OF THE DRAWINGS

FIGS. 4-A, 4-B and 4-C show that the pilot device floats in the fluid to spread out the display device;

DETAILED DESCRIPTION OF THE PREFERRED EMBODIMENTS

Figure 1:
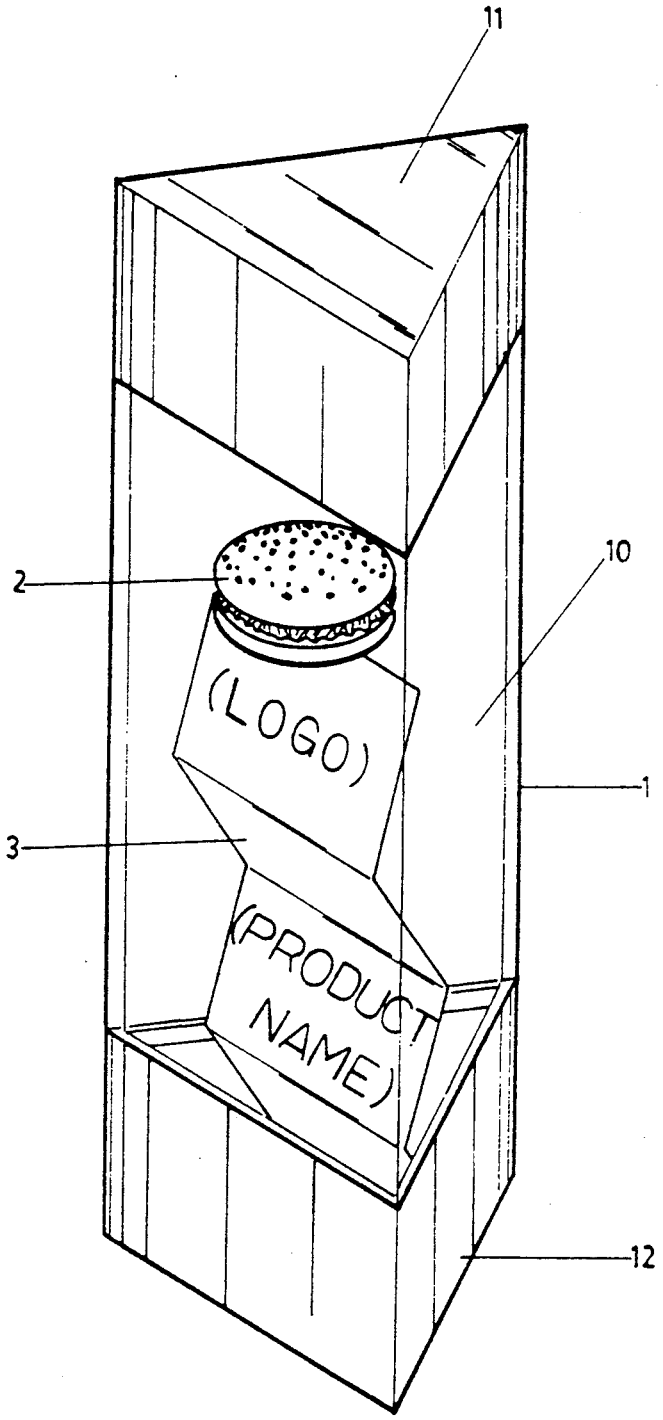
FIG. 1 is a perspective view of a fluid-contained display ornament embodying the present invention.
Figure 2:
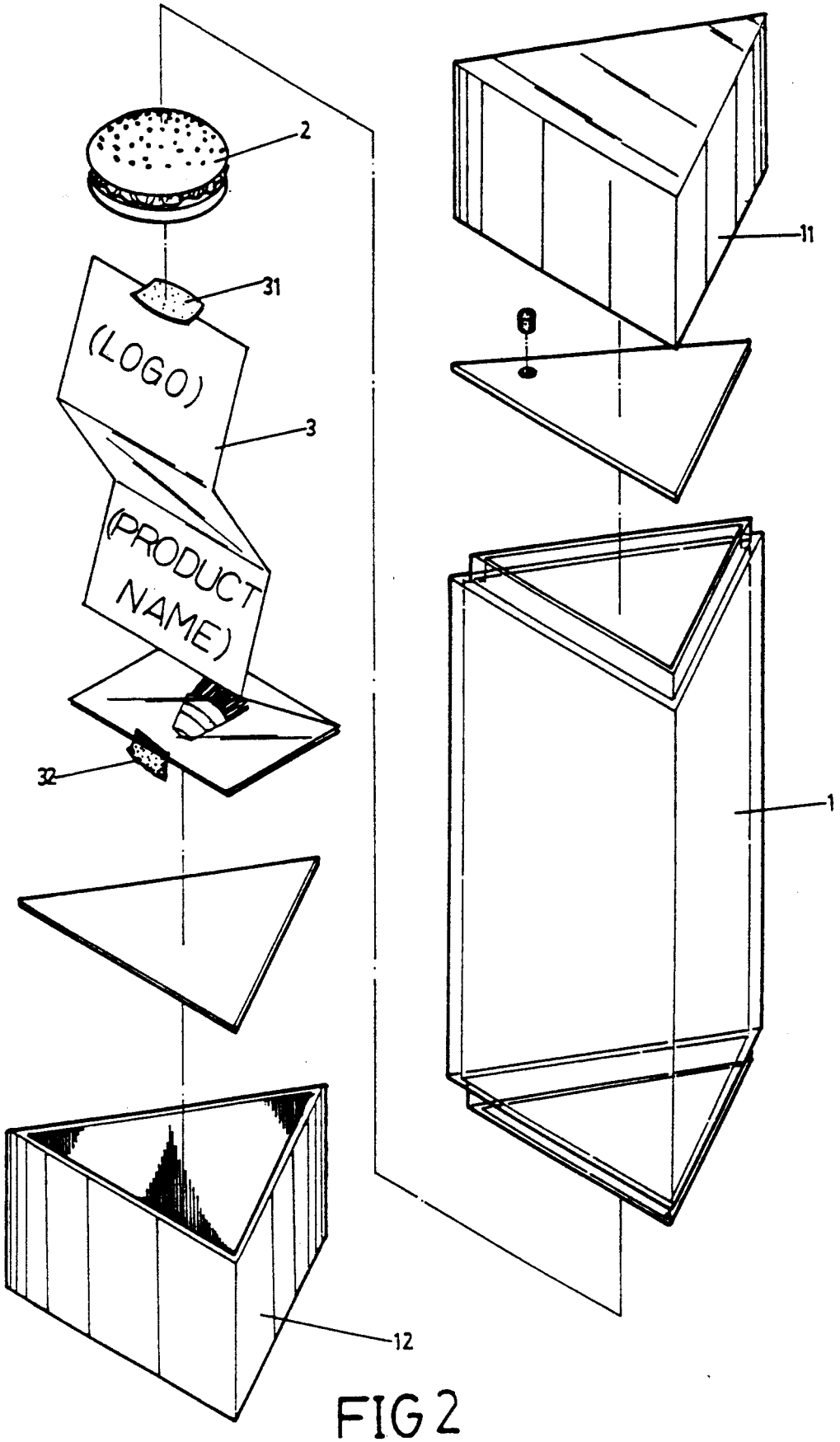
FIG. 2 is an exploded view of the fluid contained display ornament of FIG. 1.

Referring to FIGS. 1 and 2, a fluid-contained display ornament as constructed in accordance with the present invention is generally comprised of a fluid container 1, a pilot device 2, and a display device 3. The fluid container 1 comprises a transparent body 10 made in any of a variety of geometrical shapes (for example, the shape of a hollow, triangular prism) and covered with two opaque caps, namely, the top cap 11, and the bottom cap 12 at two opposite ends thereof for holding a fluid.

The pilot device 2 may be made from any of a variety of materials that have a specific gravity lower than that of the fluid contained in the transparent container 1 so that it floats once it has been put into the fluid. The pilot device 2 may be made in any of many shapes. The display device 3 is made from a flexible sheet folded into several folds and printed with patterns on the two opposite faces thereof, having a first connecting strip 31 at one end secured to the pilot device 2 and a second connecting strip 32 at an opposite end secured to one cap 12 of the transparent container 1.

Referring to FIGS. 4-A, 4-B and 4-C, when the fluid container 1 stands on a flat surface, the pilot device 2 moves upwards in the direction from the bottom cap 12 to the top cap 11, by means of the effect of its buoyance in the fluid inside the transparent body 10 of the fluid container 1, and therefore, the display device 3 is simultaneously carried upwards into an expanded position for showing the patterns marked thereon. Turning the fluid container 1 upside-down causes the pilot device 2 to move in the direction from the top cap 11 to the bottom cap 12, and therefore, the display device 3 is forced to be folded up and received inside the bottom cap 12 again.

Figure 3:
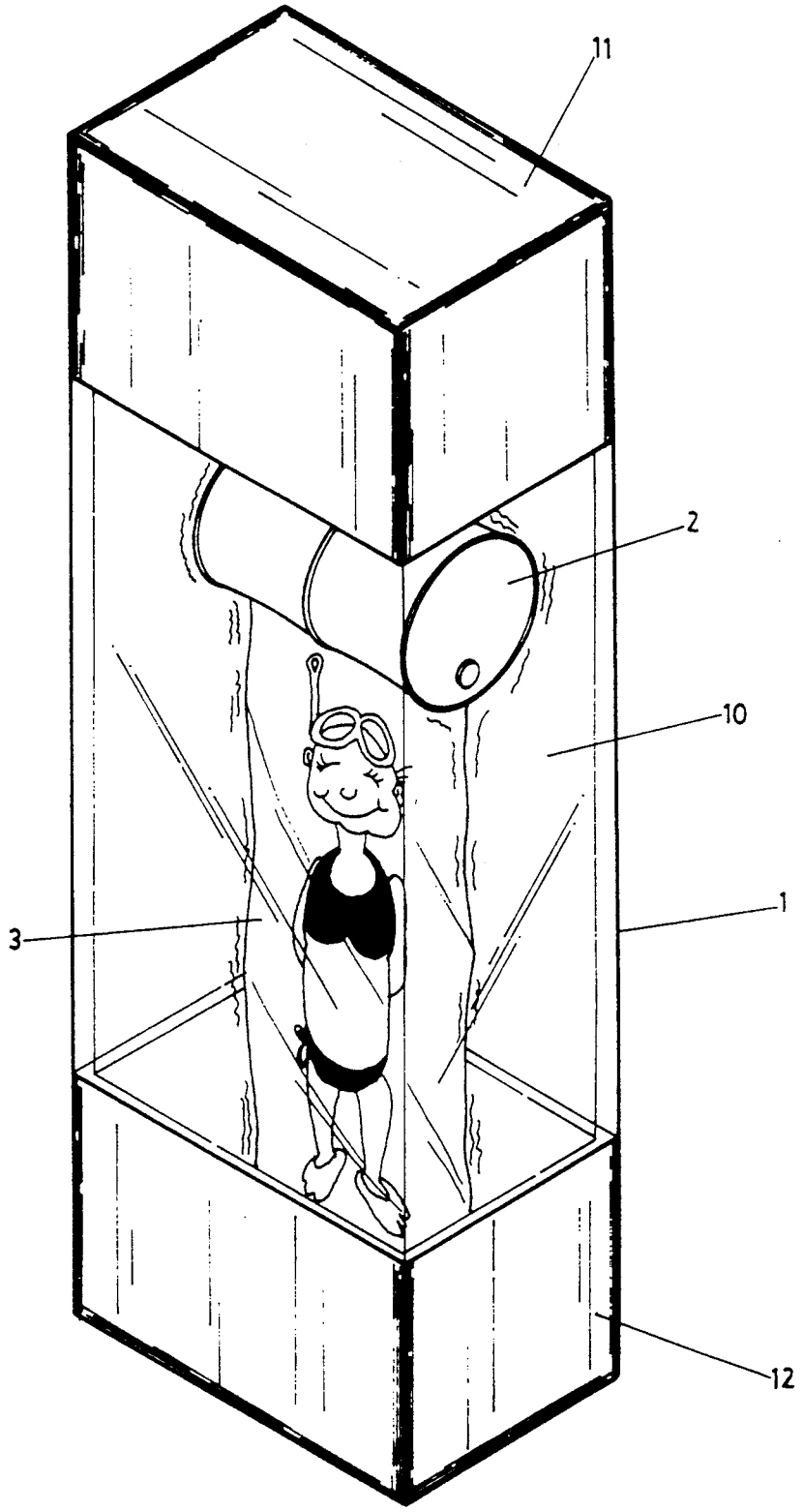
FIG. 3 is a perspective view of an alternate form of the present invention.

FIG. 3 illustrates an alternate form of the present invention, in which the fluid container 1 is made in the shape of a hollow, quadratic prism; the pilot device 2 is made from a buoyance float; the display device is made from a cloth.

Figure 5:
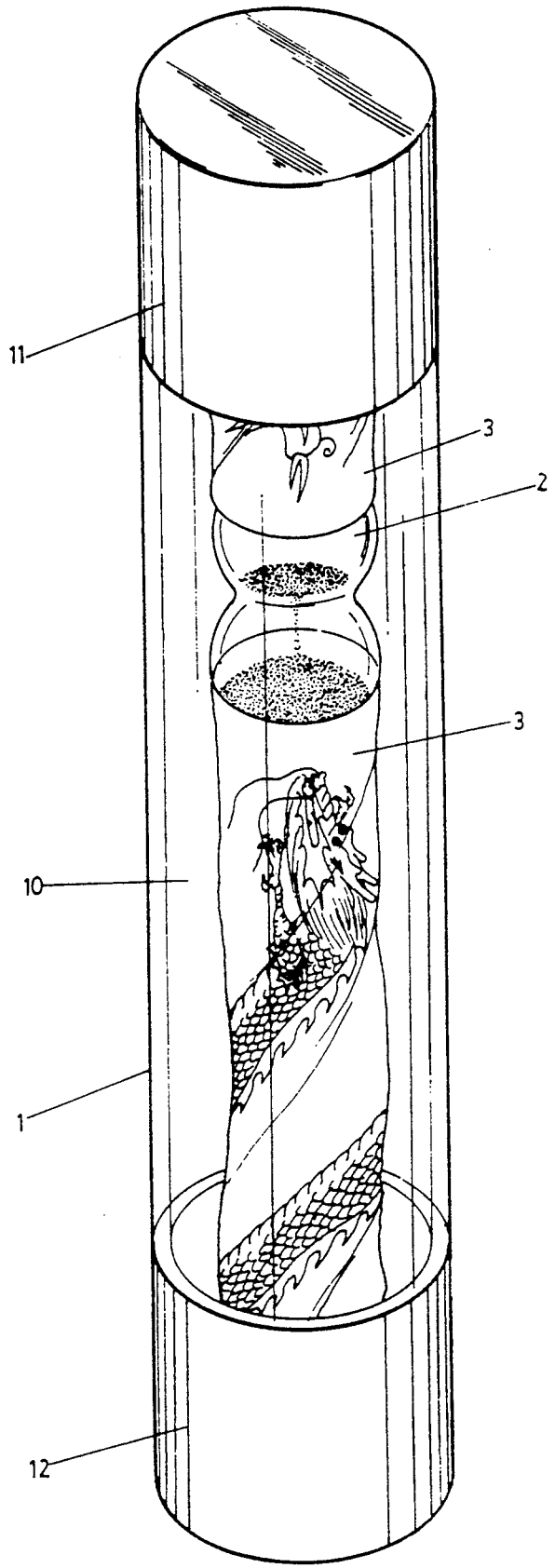
FIG. 5 is a perspective view of another alternate form of the present invention showing that a pilot device is connected between two display devices.

FIG. 5 illustrates another alternate form of the present invention, in which a pilot device 2 is connected between two display devices 3, of which each has one end secured to either cap 11 or 12 of the fluid container 1. Therefore, one display device is spread for exhibition while the other display device is concealed inside a cap. Turning the fluid container 1 upside-down causes the two display devices to make a change, i.e. the one in exhibition becomes concealed inside the cap while the previously concealed one becomes spread out for exhibition.

Figure 6:
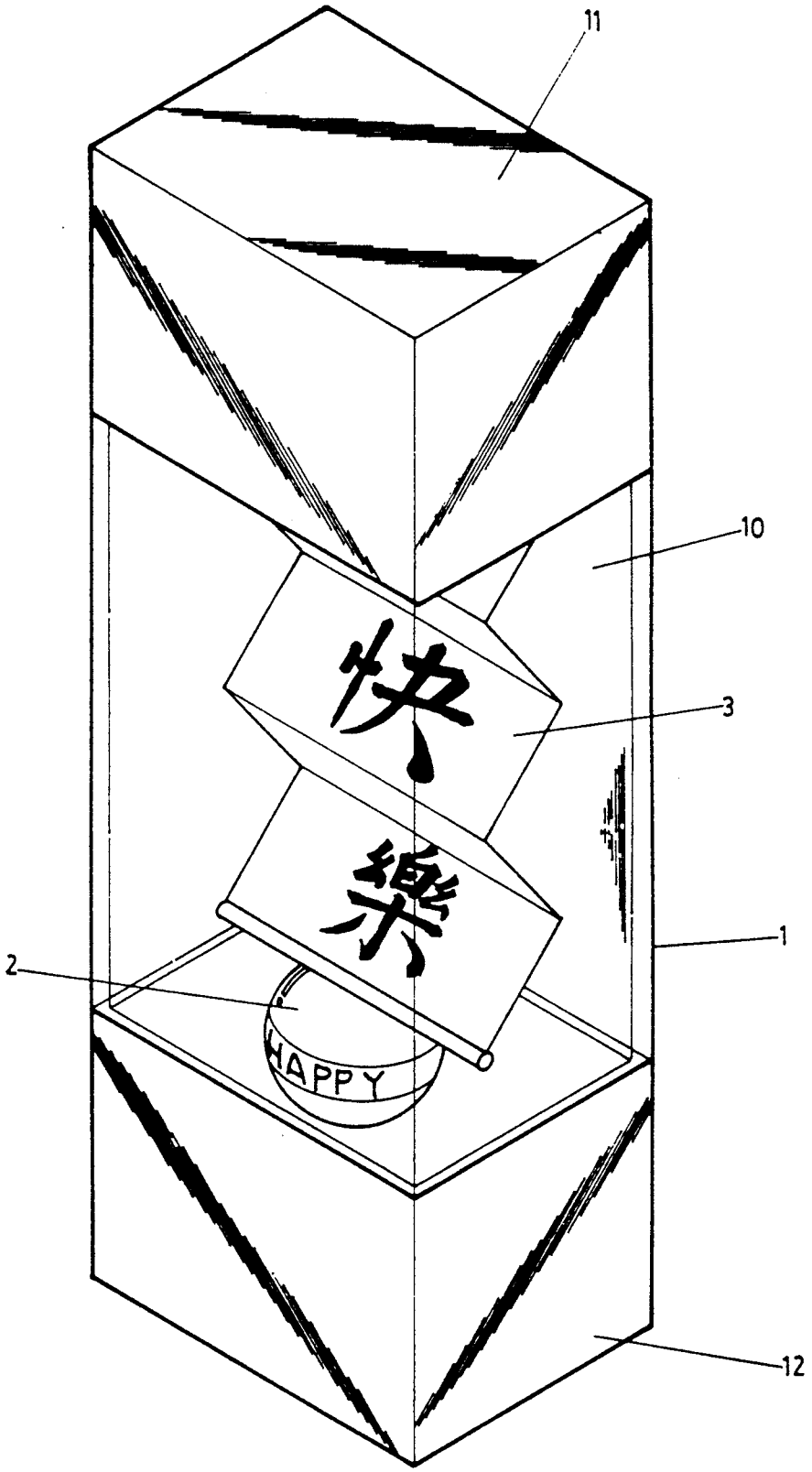
FIG. 6 is a perspective view of still another alternate form of the present invention showing that the pilot device sinks in the fluid inside the fluid container to spread out a display device.

Referring to FIG. 6 illustrates still another alternate form of the present invention, in which the pilot device 2 is made from a heavy material having a specific gravity higher than that of the fluid contained inside the fluid container so that the pilot device 2 sinks once it has been put into the fluid.

What is claimed is:

1. A fluid-contained display device comprising:

a) a transparent fluid container with opposite ends and having therein a fluid with a first specific gravity;

b) a movable pilot element located in the fluid within the container, the pilot element having a second specific gravity different from the first specific gravity such that, when the pilot element is located adjacent to one end of the container, it will move toward the opposite end when the container is inverted; and, c) at least one display member having a first end portion attached to the pilot element and a second end portion attached to an end of the container such that as the pilot element moves toward the end of the container to which the display member is attached, the at least one display member is collapsed, and as the pilot element moves toward the opposite end of the container, the at least one display device is expanded.

2. A fluid-contained display device of claim 1, further comprising two opposite opaque caps attached to opposite ends of the transparent fluid container.

3. The fluid-contained display device of claim 1, wherein the second specific gravity of said pilot element is less than the first specific gravity of the fluid so that the pilot element floats in said fluid.

4. The fluid-contained display device of claim 1, wherein the second specific gravity of said pilot element is greater than the first specific gravity of the fluid so that the pilot element sinks in said fluid.

5. The fluid-contained display device of claim 1 wherein said display member comprises a cloth having indicia printed thereon and further comprising a first connecting strip at one end secured to said pilot element and a second connecting strip at an opposite end secured to one end of said transparent fluid container.

* * * * *